US008358037B2

(12) United States Patent
Bischoff et al.

(10) Patent No.: US 8,358,037 B2
(45) Date of Patent: Jan. 22, 2013

(54) CIRCUIT CONFIGURATION FOR OPERATING A HOUSEHOLD APPLIANCE

(75) Inventors: Martin Bischoff, Falkensee (DE); Holger Helmschmidt, Regensburg (DE); Lothar Knopp, Berlin (DE); Guido Sattler, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 373 days.

(21) Appl. No.: 12/745,927

(22) PCT Filed: Nov. 5, 2008

(86) PCT No.: PCT/EP2008/065007

§ 371 (c)(1),
(2), (4) Date: Jun. 3, 2010

(87) PCT Pub. No.: WO2009/071412

PCT Pub. Date: Jun. 11, 2009

(65) Prior Publication Data

US 2010/0271848 A1 Oct. 28, 2010

(30) Foreign Application Priority Data

Dec. 5, 2007 (DE) ..... 10 2007 058 379

(51) Int. Cl.
*H01H 47/00* (2006.01)

(52) U.S. Cl. ..... 307/115; 307/113

(58) Field of Classification Search ..... 307/10.4, 307/29, 39, 64, 66, 104, 105, 113, 115, 117, 307/118, 140, 141; 320/101, 133, 140, 156, 320/160; 363/16–20, 37, 50, 56.07, 89, 96, 363/134, 136

See application file for complete search history.

(56) References Cited

U.S. PATENT DOCUMENTS

| | | | | |
|---|---|---|---|---|
| 5,070,253 | A * | 12/1991 | Wagner | 307/75 |
| 5,072,328 | A | 12/1991 | Dvorak et al. | |
| 5,239,203 | A * | 8/1993 | Thorngren | 307/116 |
| 5,606,480 | A * | 2/1997 | Nevo | 361/46 |
| 5,850,559 | A | 12/1998 | Angelo et al. | |
| 6,291,910 | B1 | 9/2001 | Mori et al. | |

(Continued)

FOREIGN PATENT DOCUMENTS

| | | |
|---|---|---|
| CN | 87208790 U | 9/1988 |
| DE | 2250674 | 4/1974 |
| DE | 2816558 A1 | 10/1979 |

(Continued)

OTHER PUBLICATIONS

Report of Examination including National Search Report CN 200880119441.6.
Report of Examination DE 10 2007 058 379.8.

*Primary Examiner* — Rajnikant Patel
(74) *Attorney, Agent, or Firm* — James F. Howard; Andre Pallapies

(57) ABSTRACT

A circuit for operating a household appliance, having a switching power supply for transforming a grid voltage of a supply grid to a direct current supply voltage, a controller for controlling processes of the household appliance that can be coupled to the switching power supply and supplied by the DC supply voltage, and a button by means of which the switching power supply can be coupled to the supply grid by closing an electrical switch. The switch has two mechanically stable states and can be transitioned from one mechanically stable state to the other by actuating the button and/or by an at least indirect energy input from the controller.

6 Claims, 1 Drawing Sheet

U.S. PATENT DOCUMENTS

| | | | | |
|---|---|---|---|---|
| 6,445,090 | B1 | 9/2002 | Mori et al. | |
| 6,522,033 | B1 * | 2/2003 | Nevo | 307/125 |
| 7,973,431 | B2 * | 7/2011 | Feldmeier | 307/115 |
| 2004/0140191 | A1 | 7/2004 | Jerg et al. | |

FOREIGN PATENT DOCUMENTS

| | | | |
|---|---|---|---|
| DE | 3045715 | A1 | 6/1982 |
| DE | 4243991 | A1 | 6/1994 |

* cited by examiner

CIRCUIT CONFIGURATION FOR OPERATING A HOUSEHOLD APPLIANCE

BACKGROUND OF INVENTION

The present invention relates to a circuit configuration for operating a household appliance as well as to a household appliance with such a circuit configuration. The invention further relates to a corresponding method.

This invention focuses on automatically switching off a household appliance. Conventional solutions for automatic switch-off currently usually operate with electronic circuits which have electronically-driven self-holding and in which the household appliance is switched on by an operator and subsequently remains in the switched-on state until a command for switching off the device is set either by the operator or by the device itself. A disadvantage of these solutions lies in the fact that electrical energy is necessary for self-holding. In addition power outages lead to the undesired switching off of the device.

Publication DE 2250674 discloses a configuration for automatic restoration of the switch-on state of a load after a short-duration outage or fall in the supply voltage in load circuits with the aid of a bridging timer defining a maximum bridging time which is started by an information provider connected to the grid power on failure of the grid power supply.

BRIEF SUMMARY OF INVENTION

The object of the present invention is to provide a circuit configuration for operating a household appliance in which measures are taken that guarantee an energy-efficient and also a reliable operation of the household appliance.

The inventive circuit configuration for operating a domestic appliance has a switching power supply for transforming the grid voltage of a supply grid to a DC supply voltage, a control unit for controlling processes of the household appliance that can be coupled to the switching power supply and supplied by the DC supply voltage and a button by means of which the switching power supply can be at least indirectly coupled to the supply grid by closing an electrical switch, wherein the switch has at least two mechanically-stable states and can be transitioned from one mechanically-stable state to the other by actuating the button and/or by an at least indirect energy input from the control unit.

In other words an important idea behind the present invention lies in the fact that, in the switched-on state of the household appliance, mechanically-stable states of the electrical switch are used for self-holding. In particular the button is able to be actuated by an operator and is embodied such that after actuation it returns automatically to its initial position.

In an advantageous manner the inventive circuit configuration achieves an energy-efficient and also reliable operation of the household appliance. Especially the fact that the electrical button by means of which the switching power supply is able to be coupled to the supply grid is able to be transitioned from its first to its second mechanically-stable state on the one hand by means of the button and on the other by the control unit guarantees that an automatic, for example time-controlled switching off of the household appliance, especially after a desired process has elapsed, is achieved. In addition the mechanically-stable states of the electrical switch make it possible, in the event of a power outage, to resume the process at the process step at which it was interrupted. The control unit in particular provides the opportunity of automatically detecting whether a process of the household appliance has been switched off either by an operator, by the automatic system described above or by an unwanted power outage.

In accordance with one embodiment the electrical switch is assigned a first control element connected in series with the button. This guarantees that after an actuation of the button, especially by an operator, current flows through the first control element and the electrical switch is actuated.

Preferably the switch with the assigned first control element is embodied as a latching relay. Especially with the button, which returns to its originally position after being actuated and by means of which a latching relay is closed in a pulsed manner, the latching relay makes possible a reliable adjustment of the switch into its operating position. In addition the latching really is characterized by it having two mechanically-stable states.

In accordance with an embodiment a second electrical control element, especially a triac, is switched in parallel to the button and is able to be activated by the control unit. The second electrical control element makes it possible for the electrical switch to be activated from the control unit side. The parallel connection in the second electrical control unit with the button particularly makes possible an independent activation of the electrical switch on the one hand by means of the button and on the other hand by the control unit. Furthermore a pulse-type activation of the electrical switch from the control unit side is guaranteed by the triac activatable by the control unit, especially with a latching relay.

In accordance with an alternate embodiment the electrical switch and the button are mechanically coupled to one another and embodied such that the electrical switch, after actuation of the button, remains in its mechanically-stable closed state and through a further actuation and/or through the at least indirect supply of energy from the control unit side, can be switched to its open state. In particular the button and the electrical switch operate in accordance with a ball-point pen principle, so that an actuation of the button, especially by an operator causes the electrical switch to close, with the electrical switch remaining mechanically stable in its closed position. If the button is actuated again the electrical switch will be moved into its mechanically-stable open state. Such buttons can typically comprise a latching device shown in DE 42 43 991 A1 with a heart-shaped slot path.

Preferably the button is coupled to the control unit via a driver and can be transferred into its operating position mechanically by the latter. The result of this is that the electrical switch can also be changed on the control unit side into its operating position, especially switched from its closed into its open state.

In accordance with a further alternate embodiment the electrical switch is assigned a bistable relay including two coils, with the first coil being serially switched with the button and the second coil being at least indirectly coupled to the control unit. This guarantees that on the one hand pressing the button causes current to flow through the first coil and the electrical switch is activated directly and on the other hand the electrical switch can be activated from the control unit side by means of the second coil. The bistable relay comprising the two coils, and especially magnetic storage by means of the coil, makes possible a self-holding of the circuit configuration in the switched-on state of the household appliance.

Preferably a driver is connected between the control unit and the second coil. This makes possible a reliable driving of the bistable relay from the control unit side.

In one embodiment the bistable relay is designed to operate with AC current. This enables the bistable relay to be connected directly to the supply grid and be activated with the grid voltage.

Alternately a power supply comprising a diode and an electrical resistor can be connected between the button and the first coil and the bistable relay can be designed to operate with direct current. In particular the transformation of the grid voltage into a direct current voltage is made possible by the power supply including the diode. Furthermore a reduced-cost circuit configuration can be created by this, because the bistable relay must be designed exclusively for operation with direct current.

An inventive method is designed for operation of a household appliance. In this method the grid voltage of a power supply grid is converted by means of a switching power supply assigned to a circuit configuration into a direct current supply voltage with which a control unit for controlling processes of the household appliance is supplied. By means of a button the switching power supply is coupled to the power supply grid by closing an electrical switch, with the electrical switch having at least two mechanically-stable states and by pressing the button and/or by an at least indirect supply of energy from the control unit, can be switched from one into the other mechanically-stable state.

The preferred exemplary embodiments explained with reference to the inventive circuit configuration and especially their advantages apply correspondingly to the inventive method.

BRIEF DESCRIPTION OF THE DRAWING

Further advantages, features and details of the invention emerge from the description of the individual preferred exemplary embodiments and also with reference to the drawings. The drawings show.

DETAILED DESCRIPTION OF EXEMPLARY EMBODIMENTS OF THE PRESENT INVENTION

Identical elements or elements with the same functions are provided with identical reference signs in the figures.

Figure 1:
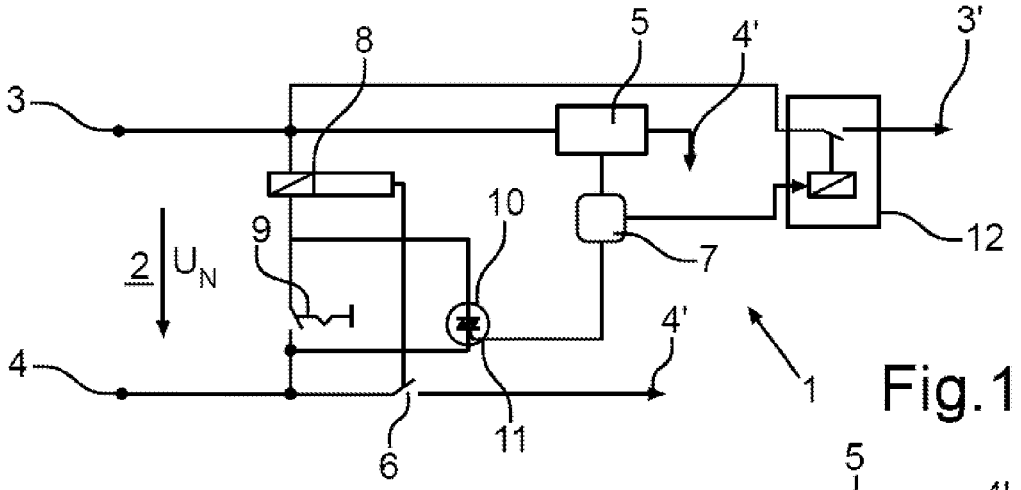
FIG. 1 a circuit configuration for operating a household appliance in accordance with a first exemplary embodiment.

A circuit configuration 1 in accordance with a first exemplary embodiment reproduced in FIG. 1 is embodied for operating a household appliance. The household appliance can be a household appliance for care of items of laundry, for example a dryer, a washing machine or a washer/dryer. The household appliance can also be embodied as an electrical device, preferably with an automatic program sequence, which can be used for other types of household control. For example it can also be embodied as a dishwasher or a cooker.

The circuit configuration 1 comprises an input 2 and is connected via a phase conductor pole 3 and also a neutral conductor pole 4 to a power supply grid. Thus a grid voltage $U_N$ is present at input 2 of the circuit configuration 1.

The circuit configuration 1 comprises a switching power supply 5 which has the task of converting the grid voltage $U_N$ into a DC supply voltage. To this end the switched power supply 5 is coupled on one side via the phase conductor pole 3 and on the other side via the neutral conductor pole 4 to the power supply grid, with an electrical switch 6 being connected between the switching power supply 5 and the neutral conductor pole 4. A switching power supply-side neutral conductor pole is labeled in FIG. 1 with the reference sign 4'.

The circuit configuration 1 further features a control unit 7 which is embodied in this example as a microcontroller, is coupled to the switching power supply 5 and is able to be supplied with the DC supply voltage. The control unit 7 is also embodied to control processes of the household appliance, such as a washing process for example.

The phase conductor pole 3 and the neutral conductor pole 4 are coupled to each other by means of a first control element 8 and a button 9. In this case the button 9 can be actuated by an operator of the household appliance and is embodied such that after an actuation it automatically returns to its initial position. If the button 9 is actuated the circuit will merely be closed for a short time by this. The first control element 8 has the task of controlling the electrical switch 6, with the electrical switch 6 being embodied with the first electrical control element 8 as a latching relay, so that in a no-load state of the first electrical control element 8 the electrical switch 6 has two different mechanically-stable states, an open state and also a closed state. If a pulse of current is applied to the first electrical control element 8 by actuating the button 9, the switch 6 is put into its operating position.

The circuit configuration 1 further comprises a second electrical control element 10 which is embodied here as a triac and is coupled to the control unit 7. The triac 10 is switched in parallel to the button 9 and has a control connection 11 via which the triac can be activated by the control unit 7. If an electrical current is present at the control connection 11, the triac 10 bridges the button 9 and thus supplies current to the first control element 8. This makes possible a system-side activation of the electrical switch 6 by means of the control unit 7.

Furthermore the circuit configuration 1 includes a relay 12 which is able to be activated by the control unit 7 and by means of which a household appliance side phase conductor pole 3' is able to be coupled to the supply grid-side phase conductor pole 3. In this case an electrical load, such a drum motor of a washing machine, can typically be driven via the relay 12.

The functioning of the circuit configuration 1 is explained in more detail below. As already explained above, the button 9 in the household appliance is accessible from outside and can be actuated by an operator for switching on or switching off the household appliance. If the button 9 is actuated, a pulse of current will be applied to the first electrical control element 8 and the switch 6 activated by the first control element 8 closed. The switch 6 in this case in its closed state has mechanical self-holding and can exclusively only be opened by a further application of a pulse of current to the first electrical control element 8. If the switch 6 is closed the grid voltage $U_N$ is present at the switching power supply 5 so that the switching power supply 5 is in operation. This means that the control unit 7 is supplied with the DC supply voltage by the switched power supply 5 and can control the processes of the household appliance accordingly via the relay 12. The objective is now to automatically switch off the household appliance of the ending of a process. To this end the control unit 7 is arranged so that it subsequently activates the triac 10 for a short time after ending of the process of the household appliance, for example for 20 ms, whereby the first electrical control element 8 will have a current pulse applied to it and the switch 6 will be opened. This reduces the energy consumption of the household appliance after ending of a process, and indeed the power consumption of a process is 0 watts after ending of a process.

If the circuit configuration 1 is now considered during operation, i.e. during the execution of a process of the household appliance, the switch 6 remains in its mechanically-stable closed position. If a power failure occurs on the power supply grid side there is no voltage at the switching power supply 5 and the control unit 7 is switched off. The intelligent solution of the mechanical self-holding of the switch 6 guarantees that after the grid supply returns the switching power supply 5 is immediately supplied with grid voltage $U_N$. This further makes possible a restart conditional on the control unit 7 of the previously interrupted process at the interruption point.

The clever arrangement of the button 9 also gives an operator the opportunity of interrupting a process of the household appliance at any time when it is running and of switching off the household appliance.

In the present invention the control unit 7 is further designed such that it is in the position to detect whether the household appliance was switched off actively by the operator, automatically after ending of process or by an undesired power outage. This is recognized on the basis of signal evaluations. Obviously the possibility is provided of being able to restart the process at the interrupted process step.

Figure 2:
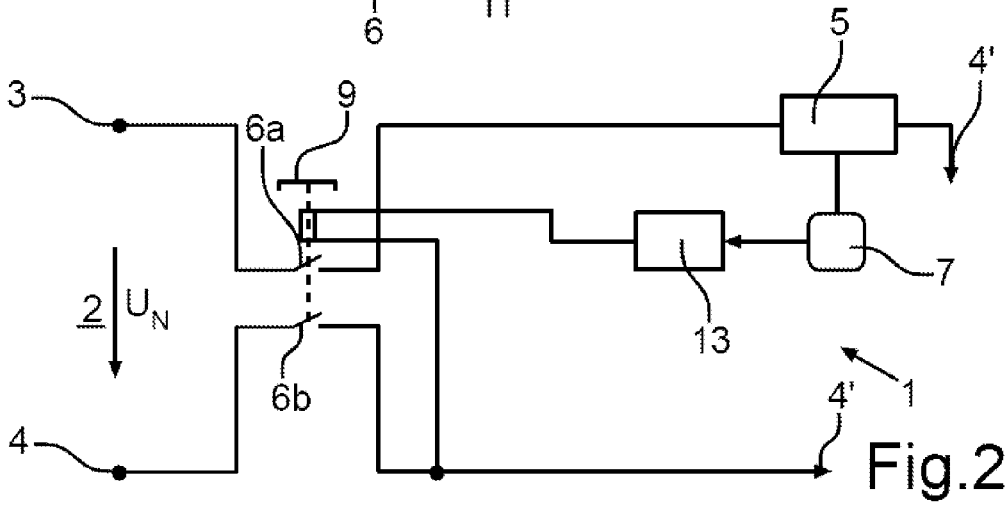
FIG. 2 a circuit configuration for operating a household appliance in accordance with a second exemplary embodiment.

A circuit configuration 1 in accordance with a second exemplary embodiment reproduced in FIG. 2 is embodied for operating, especially for automatically switching off a household appliance. As in the first exemplary embodiment the circuit configuration 1 includes a switched power supply 5 which on the one side is coupled to a phase conductor pole 3 via a first electrical switch 6*a* and on the other side to a neutral conductor pole 4 via a switching power supply-side conductor pole 4' as well as a second electrical switch 6*b*. The phase conductor pole 3 and the neutral conductor pole 4 represent an input 2 of the circuit configuration 1, with the circuit configuration 1 being connected via the input 2 to a power supply grid. A grid voltage $U_N$ is thus present between the phase conductor pole 3 and the neutral conductor pole 4. The switching power supply 5 is able to transform the grid voltage $U_N$ into a direct current supply voltage, with which is supplied to a control unit 7 coupled to the switching power supply 5. In addition the circuit configuration 1 comprises a button 9 able to be actuated in this case by an operator, which is mechanically coupled to the switches 6*a*, 6*b*. Over and above this the button 9 is coupled via a driver 13 to the control unit 7.

The button 9 and the switches 6*a*, 6*b* are embodied in accordance with the ballpoint pen principle and are thus embodied so that the two switches 6*a*. 6*b* remain in their mechanically-stable closed states after the button 9 is actuated. To this end the button 9 can have a latching position which guarantees that the switches 6*a*, 6*b* coupled mechanically to the button 9 remain in their mechanically-stable closed states.

If the household appliance is switched on by actuating the button 9, the two switches 6*a*, 6*b* will be closed and the switching power supply 5 will be supplied with the grid voltage $U_N$ and the control unit 7 will also be supplied with the DC supply voltage. The object is once more to switch off the household appliance after ending of a process to the benefit of reducing the power consumption. To this end the control unit 7 is designed so that it is in a position to actuate the button 9 via the driver 13. Here the button 9 has a reset function and can be switched by the driver 13 like a ballpoint pen into its open position. The intelligent embodiment of the button 9 and of the switches 6*a*, 6*b* in accordance with the ballpoint pen principle means that, although the household appliance is exclusively switched on by an operator, it can be switched off both by an operator and by the control unit 7.

If a power outage occurs once more on the supply grid side, there is no grid power at the switching power supply 5 and thereby no DC supply voltage at the control unit 7. Nonetheless the switches 6*a*, 6*b* remain closed because of their mechanical stability. Thus the opportunity is provided of being able to restart at the interrupted process step after the grid power returns.

As in the first exemplary embodiment, the control unit 7 is able to detect whether the household appliance was switched off by an operator, automatically after ending of a process or by an unwanted power outage.

Figure 3:
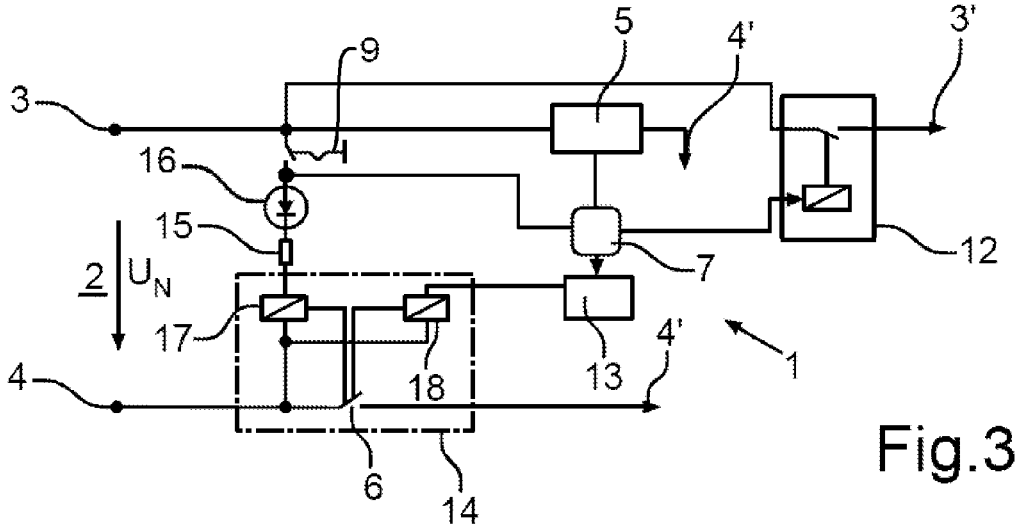
FIG. 3 a circuit configuration for operating a household appliance in accordance with a third exemplary embodiment.

FIG. 3 represents a circuit configuration 1 for operating a household appliance in accordance with a third exemplary embodiment. The circuit configuration 1 comprises an input 2 at which a grid voltage $U_N$ of a power supply grid is present between a phase conductor pole 3 and a neutral conductor pole 4. Coupled to the input 2 of the circuit configuration 1 is a switching power supply 5 such that it is switched on the one hand with the phase conductor pole 3 and on the other hand with the neutral conductor pole 4 via a switching power supply-side neutral conductor pole 4' and in addition via an electrical switch 6. Also connected to the switching power supply 5 is a control unit 7 for controlling processes of the household appliance and able to be supplied with the DC supply voltage. This control unit 7 is able to activate a relay 12 and thus drive an electrical load coupled to a household-appliance-side phase conductor pole 3' and the switching power supply-side neutral conductor pole 4', for example a drum motor of a washing machine.

In accordance with the third exemplary embodiment the electrical switch 6 is embodied as part of a bistable relay 14. This bistable relay 14 in this case comprises a first coil 17 which is connected in series with an electrical resistor 15, a diode 16 and also a button 9 able to be actuated by an operator and is connected with these components in parallel to the input 2. In addition the relay 14 has a second coil 18 which is coupled via a driver 13 to the control unit 7. The task of the two coils 17, 18 is to activate the electrical switch 6. It is guaranteed with this configuration that the operating position of the switch 6 can be adjusted on the one hand by means of the button 9 by an operator and on the other hand from the system side by the control unit 7. The obvious solution is to design the control unit 7 and/or the driver 13 and/or the second coil 18 such that the switch can be adjusted on the system side exclusively from its closed into its open position, so that it is guaranteed that the household appliance can be switched off automatically. The functionality is only intended for automatic switching off but not for automatic switching on.

So that in the switched-on state of the household appliance the control unit 7 can detect an actuation of the button 9, the terminal of the button 9 connected to the diode 16 is also linked electrically to the control unit 7 with a signal line.

In this embodiment the bistable relay 14 is embodied for operation with direct current. This is made possible by the power supply including the diode 16 and the resistor 15 which has the task of transforming the grid voltage $U_N$ into a DC voltage. Alternately the bistable relay can also be embodied for operation with AC voltage, with the diode 16 and the resistor 15 no longer being needed in this case.

The functioning of the circuit configuration in accordance with the third exemplary embodiment is explained in greater detail below. If the button 9 is actuated by an operator, current flows through the first coil 17 and the switch 6 is closed. Because of the bistability of the relay 14 the switch 6 is kept mechanically stable in its closed state. Now the switching power supply 5 is supplied with the grid voltage $U_N$ and the control unit 7 with the DC supply voltage. The processes of the household appliance can now be controlled and executed by the control unit 7. If a desired process is ended, the relay 14 and to put it more precisely the second coil 18 are controlled by the control unit via the driver 13 and the switch 6 is opened. This guarantees that the household appliance does not consume any more power after ending of a process.

If an operator would like to interrupt a household appliance process that is running, the button 9 is actuated, whereby the contact of the button 9 closes and current is briefly supplied to the first coil. Since the switch 6 is already closed, the supply of current to the coil 17 does not cause any change to the switching state of the switch 6. The control unit 7 monitors the signal line linked to the button 9 and is embodied such that the actuation of the button (sampling pulse) is registered for the closed switch 6, after which the control unit 7, after completed and registered sampling pulse, activates the coil 18 via the driver 13 and opens the switch 6, which disconnects the household appliance from the power supply grid. Thus an operator has the opportunity at any time of interrupting an ongoing process of the household appliance.

In the event of a power outage on the power supply grid side it is guaranteed by the bistable relay 14 and by the mechanical self-holding that a previously interrupted process is able to be restarted after the grid power is restored.

As in the other exemplary embodiments the control unit 7 is embodied so that it is able to recognize whether the household appliance has been actively switched off by an operator, automatically switched off after the ending of a process or switched off by an unwanted power outage on the power supply grid side.

The invention claimed is:

1. A circuit for operating a household appliance comprising:

a switching power supply for transforming a grid voltage of a supply grid into a direct current supply voltage;

a controller for controlling processes of the household appliance, which is coupled to the switching power supply and is able to be supplied with the direct current supply voltage; and a button for coupling the switching power supply to the supply grid by closing an electrical switch that has two mechanically-stable states, the switch being transitionable from one mechanically-stable state into another mechanically-stable state by actuating the button and/or by an indirect supply of energy from the controller, wherein the electrical switch has a first controller connected in series with the button, wherein the electrical switch comprise a latching relay and a triac is connected in parallel to the button that is able to be activated by the controller.

2. A circuit for operating a household appliance comprising:

a switching power supply for transforming a grid voltage of a supply grid into a direct current supply voltage;

an electrical switch that is transitionable from a first mechanically-stable state to a second mechanically-stable state to couple the switching power supply with the direct current supply voltage;

a controller coupled to the switching power supply for controlling processes of the household appliance and suppliable with a direct current supply voltage and that transitions the electrical switch from the first state to the second state by an indirect supply of energy from the controller; and a button for coupling the switching power supply to the power supply grid and that transitions the electrical switch from the first state to the second state by an actuation of the button, wherein the electrical switch includes a bistable relay with a first coil connected in series with the button and a second coil coupled to the controller.

3. The circuit of claim 2, further comprising a driver connected between the controller and the second coil.

4. The circuit of claim 2, wherein the bistable relay operates with alternating current.

5. The circuit of claim 2, further comprising a power supply comprising a diode and an electrical resistor connected between the button and the first coil and wherein the bistable relay operates with direct current.

6. A household appliance comprising:

a switching power supply for transforming a grid voltage of a supply grid into a direct current supply voltage;

an electrical switch that is transitionable from a first mechanically-stable state to a second mechanically-stable state to couple the switching power supply with the direct current supply voltage;

a controller coupled to the switching power supply for controlling processes of the household appliance and suppliable with a direct current supply voltage and that transitions the electrical switch from the first state to the second state by an indirect supply of energy from the controller; and a button for coupling the switching power supply to the power supply grid and that transitions the electrical switch from the first state to the second state by an actuation of the button, wherein the electrical switch includes a bistable relay with a first coil connected in series with the button and a second coil coupled to the controller.

* * * * *

UNITED STATES PATENT AND TRADEMARK OFFICE

CERTIFICATE OF CORRECTION

PATENT NO. : 8,358,037 B2
APPLICATION NO. : 12/745927
DATED : January 22, 2013
INVENTOR(S) : Bischoff et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 413 days.

Signed and Sealed this
First Day of September, 2015

Michelle K. Lee

Michelle K. Lee
*Director of the United States Patent and Trademark Office*